United States Patent [19]

Wagner et al.

[11] Patent Number: 4,969,537

[45] Date of Patent: Nov. 13, 1990

[54] MUFFLER ASSEMBLY AND METHOD OF MANUFACTURE

[75] Inventors: Wayne M. Wagner, Apple Valley; John A. Campbell, Lakeville, both of Minn.; William L. Burchett, Grinnell, Iowa; John S. Wiese, Bloomington, Minn.; John R. Hiemstra, Apple Valley, Minn.; Timothy A. Bethke, Apple Valley, Minn.

[73] Assignee: Donaldson Company, Inc., Minneapolis, Minn.

[21] Appl. No.: 269,571

[22] Filed: Nov. 10, 1988

[51] Int. Cl.[5] ..... F01N 1/08

[52] U.S. Cl. ..... 181/255; 181/264; 181/268; 181/272

[58] Field of Search ..... 181/247–249, 181/255, 264, 272, 268

[56] References Cited

U.S. PATENT DOCUMENTS

| | | | |
|---|---|---|---|
| 3,672,464 | 6/1972 | Rowley et al. | 181/253 |
| 4,023,645 | 5/1977 | Retka et al. | 181/276 |
| 4,325,460 | 4/1982 | Hoppenstedt | 181/259 |
| 4,368,799 | 1/1983 | Wagner | 181/255 |
| 4,580,657 | 4/1986 | Schmeichel et al. | 181/255 |
| 4,632,216 | 12/1986 | Wagner et al. | 181/255 |

*Primary Examiner*—Benjamin R. Fuller

*Attorney, Agent, or Firm*—Merchant, Gould, Smith, Edell, Welter and Schmidt

[57] ABSTRACT

A muffler assembly includes an inner outlet tube having a tubular portion, a frusto-conical portion and a flange portion having an expanded orifice facing the outlet of an inlet tube. Both the outlet tube and inlet tube extend within a chamber defined in an outer housing. The chamber is divided into two or more subchambers by a baffle which extends between the outlet tube and the housing. One or more holes in the baffle improve the sound attenuation characteristics of the muffler. The invention also comprehends a novel blank used in forming the outlet tube, and three alternative methods which may be used to form the outlet tube.

6 Claims, 9 Drawing Sheets

MUFFLER ASSEMBLY AND METHOD OF MANUFACTURE

BACKGROUND OF THE INVENTION

1. Field of the Invention

The present invention relates to muffler assemblies of the type which are used to dampen exhaust noise which is produced by an internal combustion engine. More particularly, the present invention relates to an improved outlet tube and baffle assembly for such a muffler, an improved method of manufacture and to a novel blank which may be used to form an improved outlet tube.

2. Description of the Prior Art

Various types of sound attenuation devices are known in the art which accomplish to some degree the function of silencing the device to which they are attached. One class of such devices which have been found highly effective are the venturi sound suppression devices such as those which are disclosed in U.S. Pat. Nos. 3,672,464 and 4,267,899. A closely related use of venturis is in exhaust ejectors. Many engine air cleaners are typically designed so that particulate matter separated out may be continuously removed or scavenged through a source of negative pressure connected to the air cleaner, and it is known that a suitable negative pressure for this purpose can be obtained by inserting a venturi into an engine exhaust tube and a scavenge tube into the venturi. The venturi and scavenge tube thus form an ejector which may or may not be combined with a muffler. Such an ejector arrangement is shown in U.S. Pat. No. 3,137,553, to Billey. It is also known to combine the functions of muffling and ejection into a single unit, such as is shown in U.S. Pat. No. 3,419,892, issued to Wagner et al. Wagner et al related to a circular venturi which had excellent back pressure and scavenge performance. It required, though, spun or die formed parts. In order to reduce the manufacturing cost of such a device, Schmeichel et al developed an integral fluted tube for sound suppression and exhaust ejection which is disclosed in U.S. Pat. No. 4,580,657. In this device, an exhaust tube was formed of a cylindrical portion with a generally circular inlet and outlet and a constricted portion therebetween which was not circular in cross-section, but rather had an irregular fluted shape.

Recently, a new design has become commercially available from Nelson Industries Inc., which is located in Stoughton, Wisconsin. This design includes a housing; a three-piece outlet tube having a tube portion, a cone portion and a flange portion; an intermediate baffle and support having a bleed hole therein; and a solid baffle member which does not allow sound waves to bleed therethrough. The tube, flange and cone portions are formed from three separate pieces which are apparently welded together during manufacturing. Although this design was an improvement over prior art efforts in terms of manufacture, it is recognized that slight changes in configuration of elements cause different interference patterns of sound waves of the same and different frequencies, and research continues to develop muffler designs having better sound suppression results, reduced back pressure, and/or manufacturing processes which are less costly than those previously known. It is in this sense that the present invention assumes significance relative to the art, and, in this regard, the discussion hereinafter points out the advantages thereof.

SUMMARY OF THE INVENTION

Accordingly, it is an object of the present invention to provide a muffler having improved sound attenuation characteristics, and which is simple and inexpensive to manufacture. In addition, it is an object of the present invention to provide a novel method for manufacturing such a muffler, and further to provide an improved blank for the formation of an outlet tube in such a muffler.

In order to achieve the foregoing objects, a muffler assembly constructed according to the present invention includes an elongate outer housing having first and second ends and an interior chamber defined therein, an inlet tube having a first end adapted for receiving exhaust gases from an engine, the inlet tube mounted at the first end of the housing and including a second end partially extending into the interior chamber and an outlet tube having a first end for receiving exhaust gases from the inlet tube and a second end, the outlet tube being mounted at the second end of the housing so that its first end extends into the chamber and having a first cylindrical section where it is mounted to the housing, a second conical section decreasing in cross-section from the first section toward the inlet tube, and a flange section which flanges outwardly from the second section to a maximum diameter proximate to but not in contact with the inlet tube, whereby exhaust noise may be efficiently attenuated.

According to a second aspect of the invention, a sheet metal blank is provided which may be formed into an integral tube-cone member for use in a muffler assembly. Such a blank has a generally rectangular tube section having an end edge, a pair of parallel side edges extending from and perpendicular to the end edge and a pair of aligned inwardly extending edges which are parallel to the end edge and extend toward each other from each of the side edges, respectively, for distances the total of which is less than the length of the end edge and a cone section having a pair of inwardly extending edges, each of which intersects one of said inwardly extending edges of said tube section so as to form an acutely angled recess therebetween, a pair of linearly extending edges angling obliquely away from said tube section, each of which is joined to an outer end of one of the inwardly extending edges of the cone section, and an arcuate edge connecting the linearly extending edges.

According to a third aspect of the invention, a method for forming an improved tube member for a muffler assembly includes the steps of providing a sheet metal blank as is described above, forming the blank into an integral tube-cone member having a tubular portion and a generally frusto-conical portion which is aligned with the tubular portion and decreases in cross-section toward an end distal from the tubular portion, providing a tubular flange member having a first end with a diameter equal to the diameter of the distal end of the tube-cone member, a radiused side wall and a second end of greater diameter than the first end and mounting the flange member at its first end to the distal end of the frusto-conical portion of the tube-cone member. In order to form the blank into an integral tube-cone member, a press may be provided having an upper die member, a lower die member and first and second mandrel sections shaped, respectively, to complement the desired interior shape of the tubular flange member and integral tube-cone member, the upper and lower die members each having recesses corresponding to the shape of the mandrels, wrapping the tube-cone blank about the first and second mandrel sections, respectively, and closing the press to form the tube-cone member.

Alternatively, a sheet metal blank having a substantially rectangular configuration may be formed into a tube. The tube may then be placed in a die set which may be closed to form a tube-cone member having a first tubular portion, a second generally frusto-conical portion and at least one closed crimped fin formed of excess sheet metal on the frusto-conical portion. As a third alternative, the tube-cone member may be formed from a rectangular blank through axial push forming.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
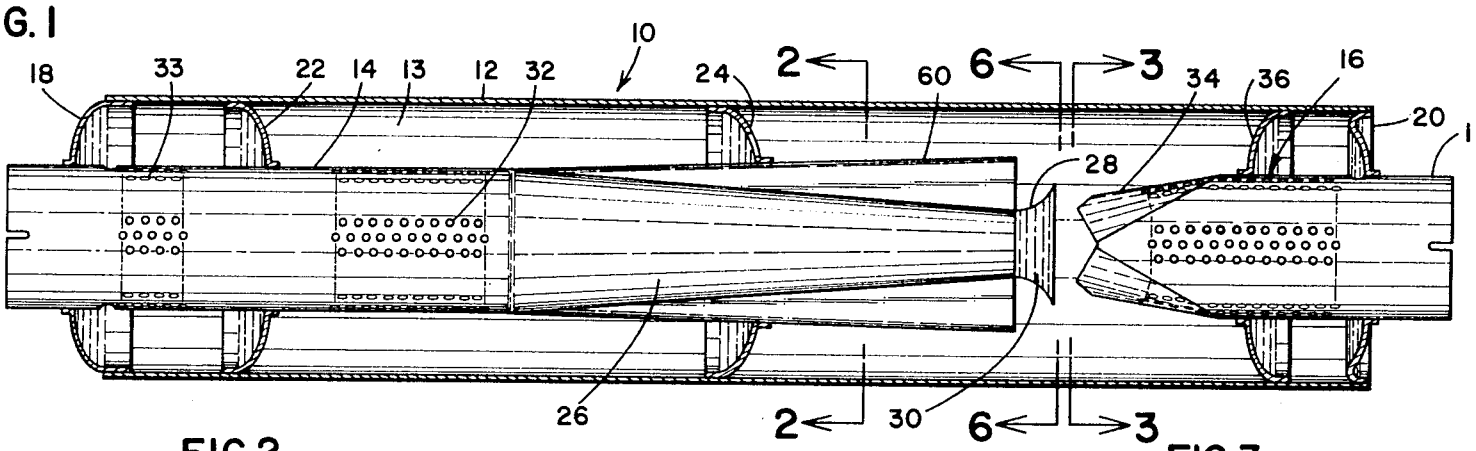
FIG. 1 is a view of a partial cross-sectional muffler constructed according to a first embodiment of the invention.
Figure 3:
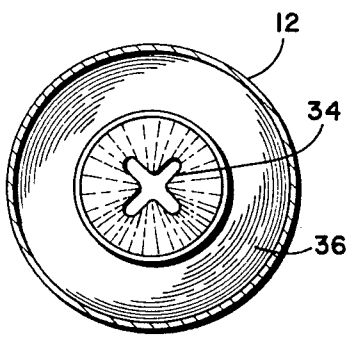
FIG. 3 is a cross-sectional view taken along lines 3—3 of FIG. 1.
Figure 2:
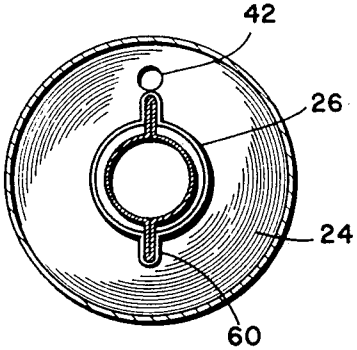
FIG. 2 is a cross-sectional view taken along lines 2—2 in FIG. 1.

Referring to FIGS. 1-3, a muffler 10 constructed according to a first embodiment of the invention is shown. Muffler 10 includes a cylindrical or oval cross-sectional housing 12 defining an interior space 13 in which sound is to be attenuated. As shown in FIG. 1, a tube-cone member 14 is supported within the interior space 13 by a first end piece 18, an intermediate support 22 and a centrally located baffle member 24. Tube-cone member 14 serves as an outlet tube, and may be coaxial with the cylindrical or oval housing 12, and extends approximately three-fourths the length of the housing. An inlet tube 16 is also supported within the housing 12 by an end piece 20 and an intermediate support 36. Inlet tube 16 is also preferably coaxial with housing 12, and terminates in a crimped outlet portion 34 that is proximate a radiused nozzle inlet 28 of the tube-cone member 14. As shown in FIG. 1, radiused nozzle inlet 28 is at a far end of a flange 30 which is attached to the conical section 26 of the tube-cone member 14.

As may be seen in FIG. 1, the centrally located baffle 24 separates the interior space 13 into two compartments, each of which helps attenuate sounds entering inlet tube 16. Tube-cone member 14 has a tubular section in which a plurality of perforations 32, 33 are formed. As may be seen in FIG. 1, perforations 32, 33 are confined to the chambers to the left of central baffle 24.

According to one novel aspect of the instant invention, the centrally located baffle 24 is provided with one or more bleed holes 42 through which sound waves may leak in order to enhance the sound attenuation characteristics of the muffler. In the embodiment illustrated in FIG. 1, the baffle 24 is disposed approximately midway along the conical section 26 of the tube-cone member 14. In an acoustical process that is not thoroughly understood by the inventors at this time, the provision of bleed holes 42 in conjunction with the surrounding structure ensures that the exhaust noise passing into inlet tube 16 will be greatly attenuated by the time it exits the outlet end 40 of the outlet tube 14.

Figure 6:
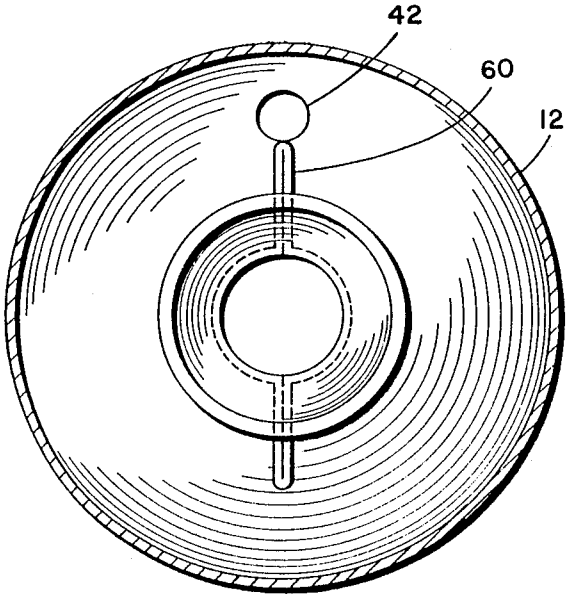
FIG. 6 is a cross-sectional view taken along lines 6—6 in FIG. 1.

An end view of the tube-cone exhaust tube member 14 is illustrated in FIG. 6. As shown, flange member 30 terminates in a circular inlet 28, which is effected by gathering up the excess sheet material in the tube-cone member 14 by crimping the excess material tightly together in a pair of closed crimped portions 60, in a manner that will be described in detail below. It has been found that such a circular orifice generally has improved sound attenuation characteristics over one having an irregular cross-section.

Figure 4A:
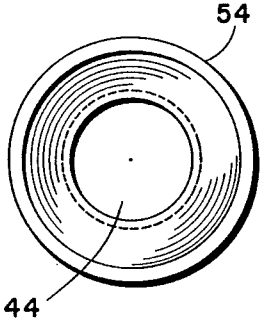
FIG. 4 is an end view of an exhaust tube constructed according to a second embodiment of the invention.
Figure 4B:
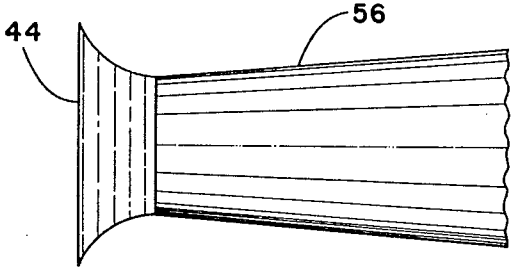

Referring to FIGS. 4A and 4B, a second embodiment of the instant invention utilizes a tube-cone member 54 having a conical section 56 and a circular inlet 44. A tube 54 that is constructed according to the embodiment of FIG. 4 may be fabricated from a pre-formed blank, as will be described below, so that it is not necessary to gather unused sheet material into a fin by crimping as in the embodiments of FIGS. 1-3 and 6.

Figure 5:
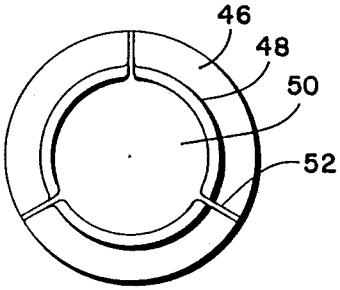
FIG. 5 is an end view of an exhaust tube constructed according to a third embodiment of the invention.

FIG. 5 is an end view, similar to those in FIGS. 4 and 6, of a tube-cone member 46 having a conical section 48 and three crimped fin portions 52 which are used to gather excess blank material in order to make possible a circular inlet orifice 50.

In operation, a muffler constructed according to any one of the embodiments illustrated in FIGS. 1-6 operates as follows. The intake tube 16 of the muffler assembly is connected to the exhaust output of an internal combustion engine which is to be quieted. As the exhaust gases containing sound waves make their way through the inlet tube 16, the above described structure acts to efficiently attenuate exhaust noises in an acoustical process that is not completely understood or describable, due to the complexity of the process. It should be noted that each of the chambers is ideally made of a different size to attenuate certain frequency ranges of the engine noise more efficiently. After passing through the entire muffler assembly, exhaust gases are emitted through the outlet end 40 of the outlet tube 14.

Figure 7:
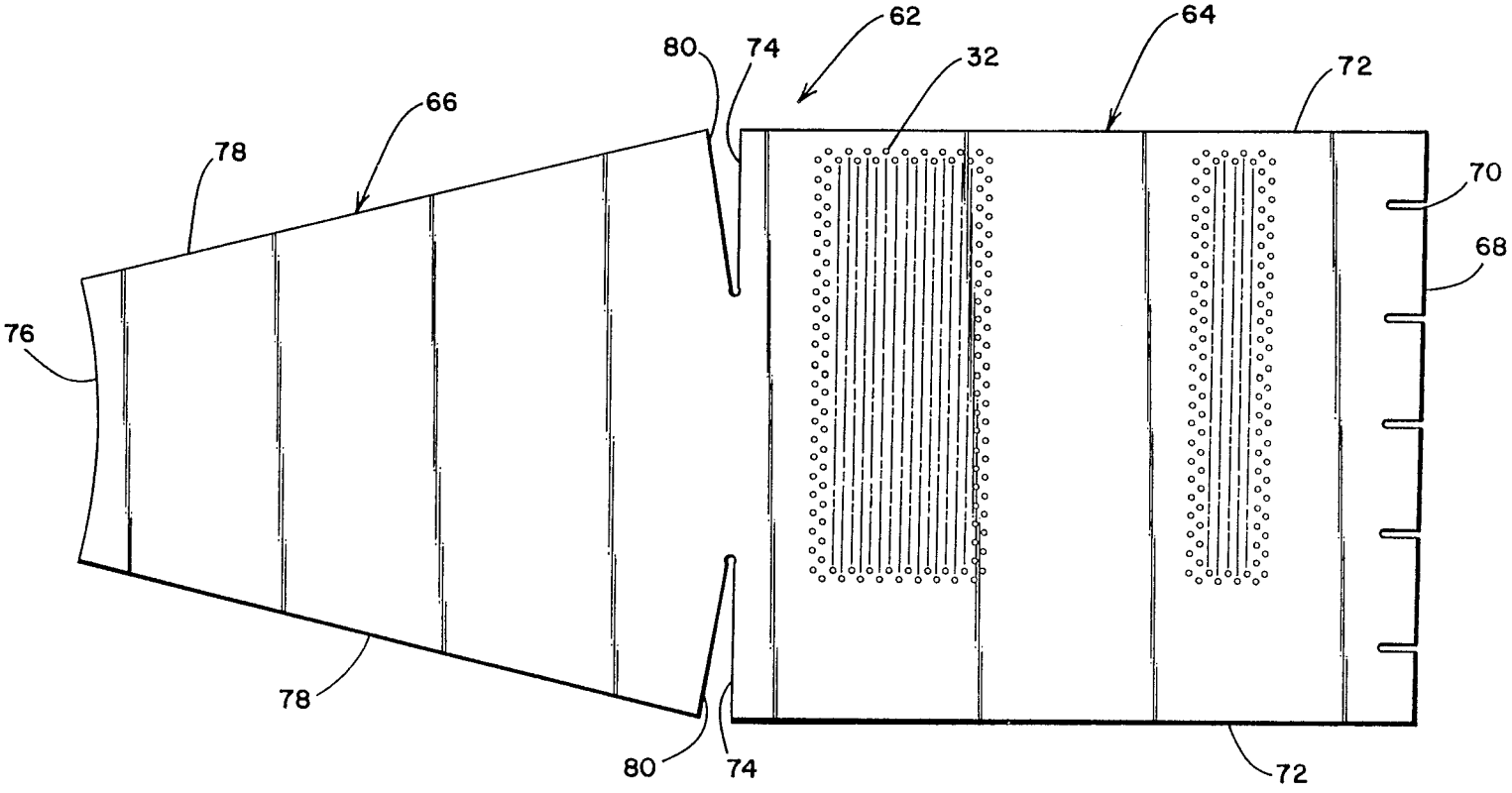
FIG. 7 is a top plan view of a sheet metal blank according to the invention.

Referring to FIG. 7, a blank 62 is illustrated for forming an integral tube-cone member such as that illustrated at 54 in the embodiment of FIG. 4. Blank 62 is preferably formed of sheet metal, and includes a tube section 64 which is designed to form the tube section of the assembly, and a cone section 66 which is designed to form the cone portion of the integral tube-cone member. Tube section 64 includes an end edge 68 having a plurality of slots 70 defined therein, and a pair of side edges 72 which are parallel with each other and perpendicular to end edge 68. Tube section 64 is further defined by a pair of first inwardly extending edges 74 which are parallel to end edge 68 and extend for a combined length which is less than that of end edge 68 so as to define a narrow neck of material therebetween which connects tube-cone section 66. Cone section 66 includes a pair of second inwardly extending edges 80 which connect to the first inwardly extending edges 74 of tube section 64. A pair of linearly extending edges 78 are connected to each of the second inwardly extending edges 80, respectively, and are angled obliquely away from tube section 64. An arcuate edge 76 connects the two linearly extending edges 78, as is shown in FIG. 7. Perforations 32 may be pre-formed in the blank 62 as required.

Figure 8:
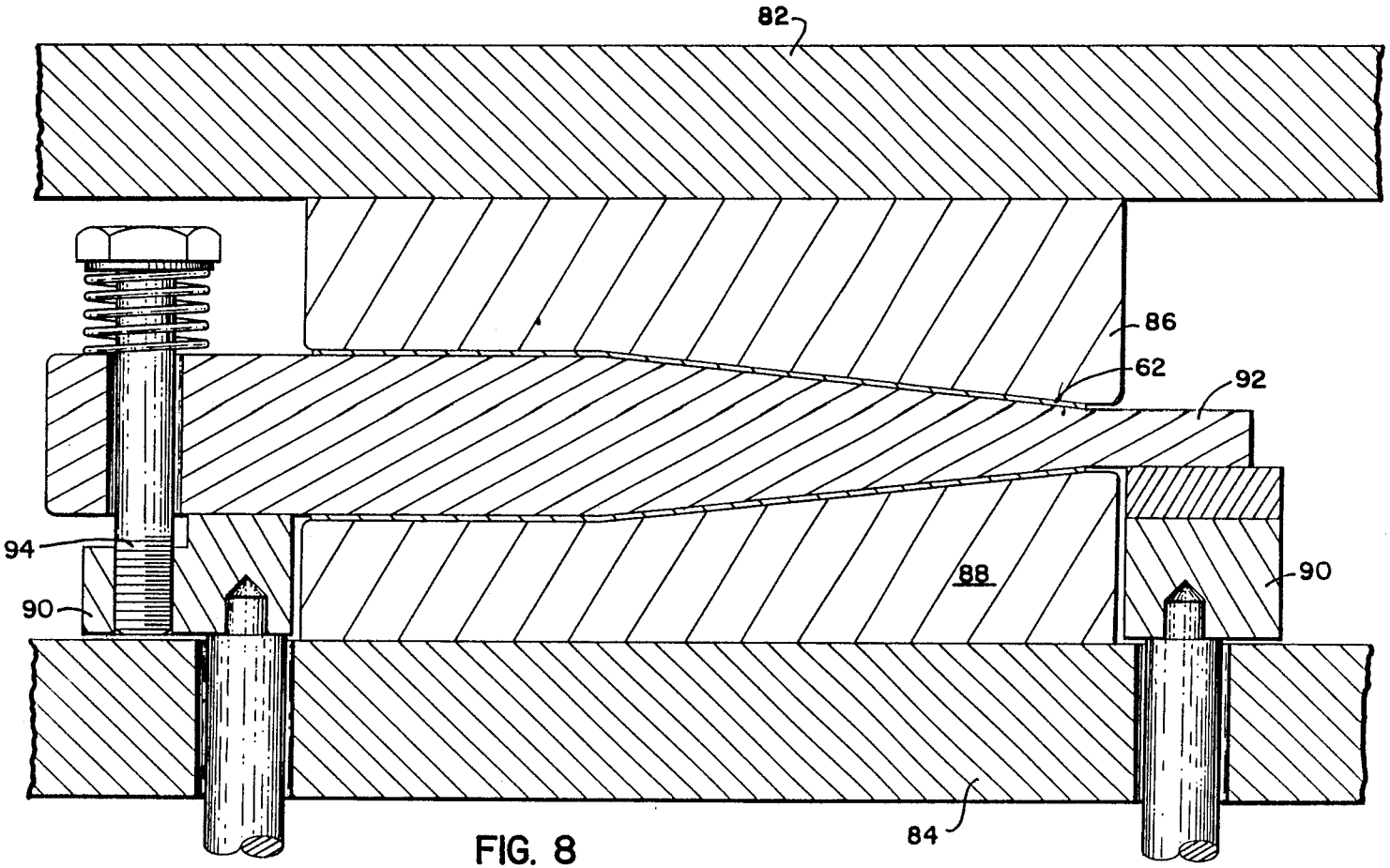
FIG. 8 is a cross-sectional view of a die assembly used according to a first method of the invention.
Figure 9:
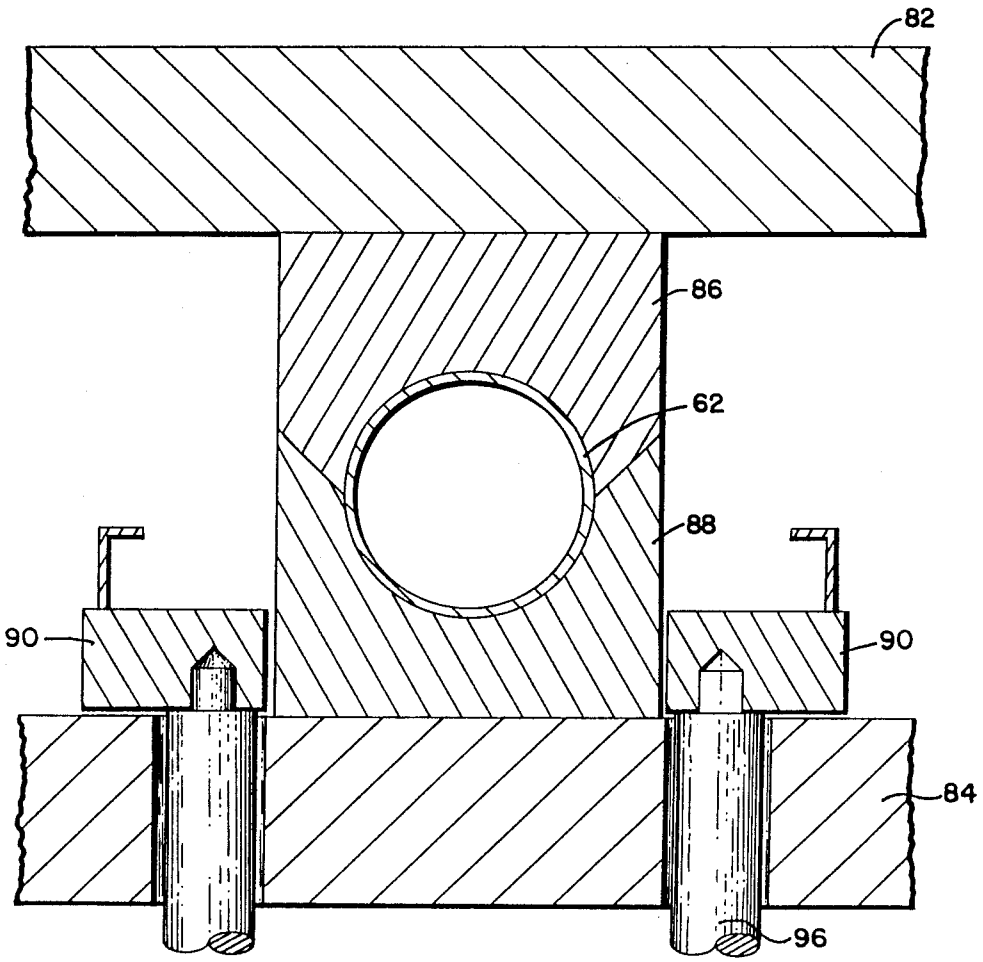
FIG. 9 is a cross-sectional view taken along lines 9—9 in FIG. 8.

Referring to FIGS. 8 and 9, the blank 62 depicted in FIG. 7 may be wrapped around a mandrel 92 prior to pressing within a die set formed by an upper die 86 and a lower die 88. An upper platen 82 and a lower platen 84 are provided to force the upper die 86 and lower die 88, respectively, together in order to form blank 62 into an integral tube-cone assembly of the type illustrated in the embodiment of FIG. 4. A pair of guide blocks 90 are provided to secure the lower die 88 on lower platen 84. Mandrel 92 is preferably secured to one of the guide blocks 90 by a pin 94, as is illustrated in FIG. 8. Guide pins 96 further align mandrel 92 and guide blocks 90 with the upper and lower die members 86, 88.

In operation, the blank 62 is pushed about the mandrel so as to loosely fit within the space defined between mandrel 92 and the upper and lower die members 86, 88, respectively. The die set is at that time closed in order to complete the formation of the integral tube-cone assembly. After pressing, the die set is pulled apart and the formed tube-cone member is removed from mandrel 92. The newly formed tube-cone member will have a seam between the edges corresponding to side edges 72 and the linearly extending edges 78, respectively, of the blank 62. The seam may then be welded shut, and a flange member 30 is then welded onto the end of the formed tube-cone assembly corresponding to the arcuate edge 76 of the blank 62. After this, the finished tube-cone assembly is then welded into place as an outlet tube within a housing, in a manner similar to that illustrated in FIG. 1.

Figure 12:
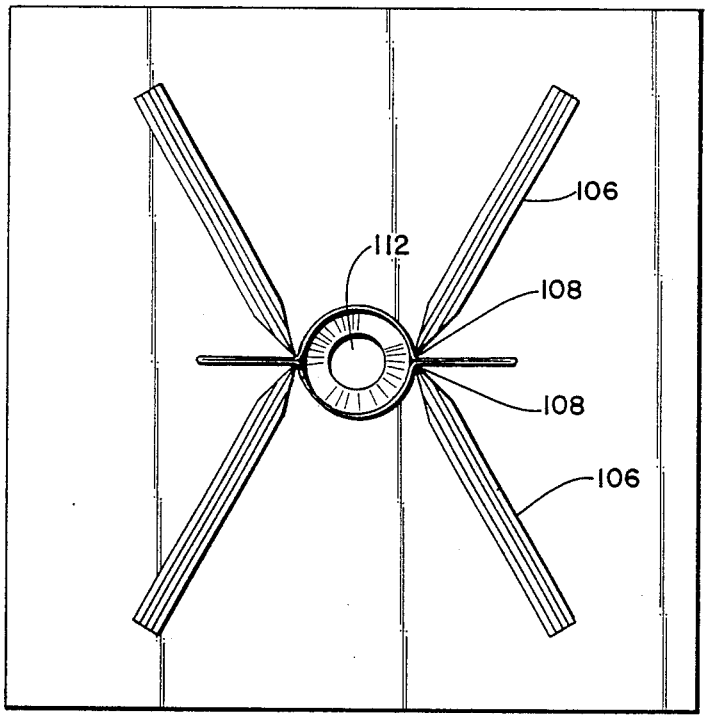
FIG. 12 is a side schematic view of a push die used according to a second method of the invention.
Figure 13:
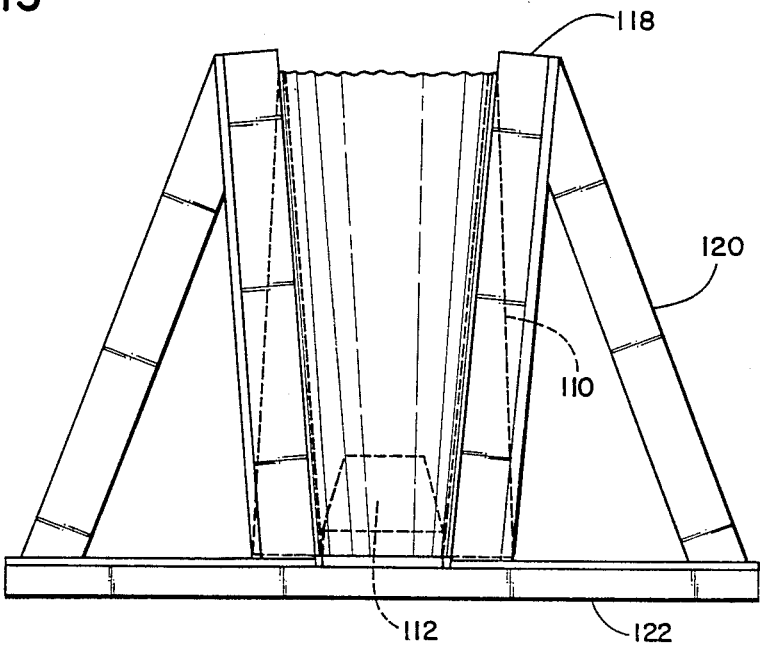
FIG. 13 is a top schematic view of the push die illustrated in FIG. 12.

FIGS. 12 and 13 are a schematic representation of a second forming method which may be used to form an integral tube-cone assembly according to the present invention. In this embodiment, a push form die assembly 102 includes at least two pairs of forming pincers 106 having edges 108 defining spaces therebetween. Pincers 106 are supported by a pair of rails 118 and support legs 120 in the manner shown in FIG. 13. In operation, a cylindrically shaped tubular blank 104 is inserted into an opening 114 about a mandrel 112. The tube is then pushed over mandrel 112, so that a tightly crimped portion 110 will be formed by the squeezing of excess tube material by the pincers 106. Once the crimped portion 110 has been formed to the desired length along the blank, the direction of the blank relative to the push form die assembly is reversed, and the formed tube-cone assembly is withdrawn from the push form die assembly 102.

Figure 14:
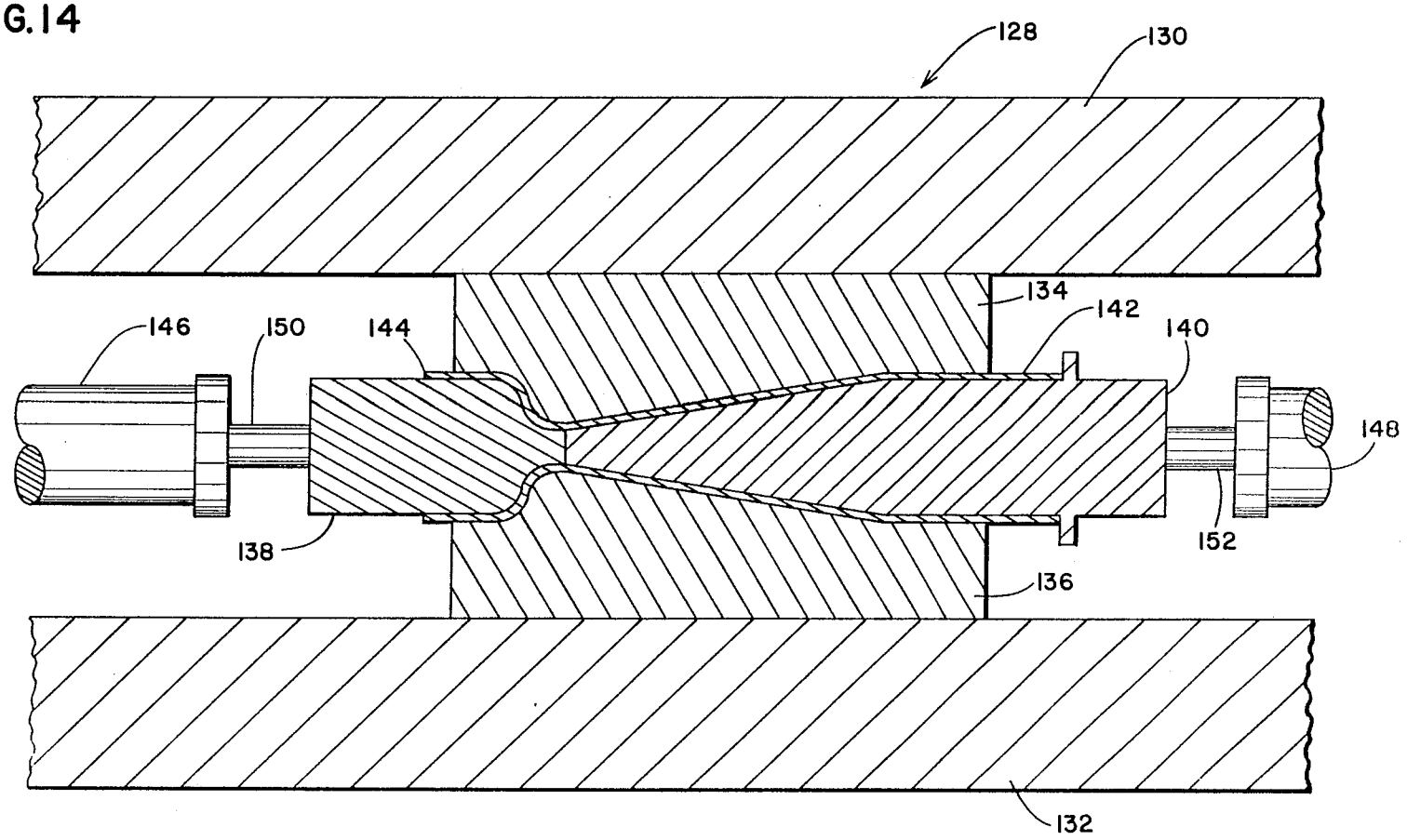
FIG. 14 is a cross-sectional view of a split mandrel die used according to a third method of the invention.
Figure 15:
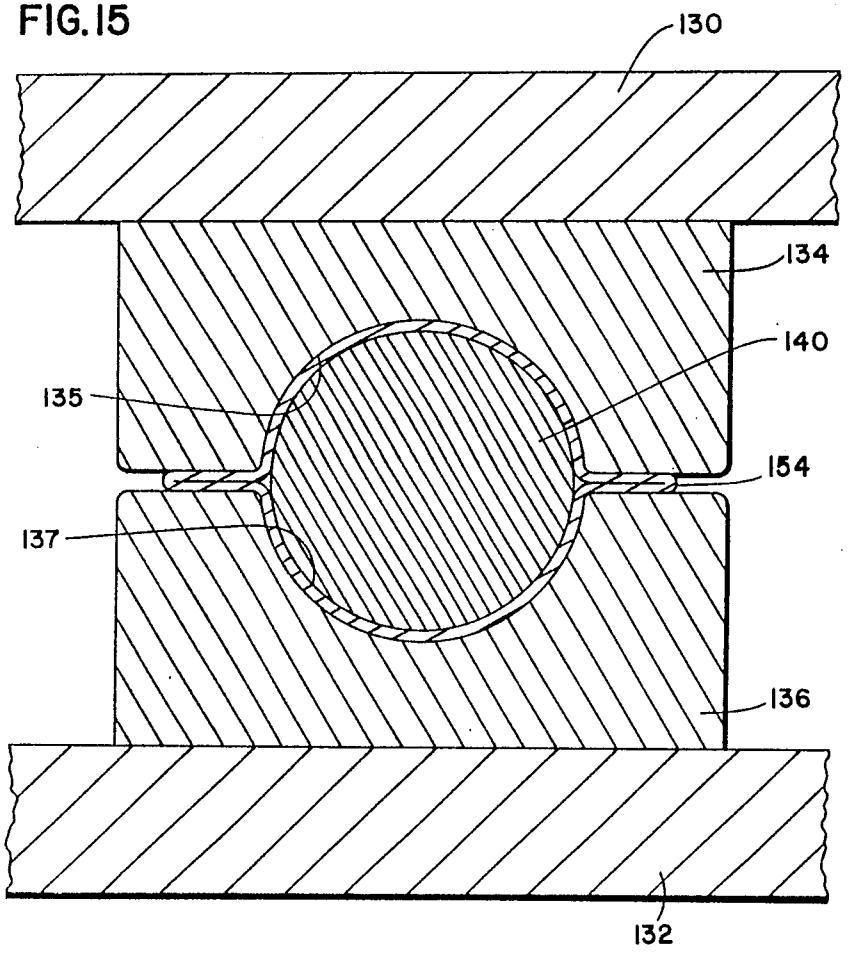
FIG. 15 is a cross-sectional view taken along lines 15—15 of FIG. 14.

FIG. 14 illustrates an apparatus for performing an assembly method wherein the flange portion and tube-cone portion of the tube-cone assembly may be simultaneously formed from a cylindrically shaped tubular blank. This second die forming assembly 128 includes an upper platen 130, a lower platen 132 and upper and lower dies 134, 136 attached to the upper and lower platens, respectively. A first mandrel section 138 is provided having an outer configuration corresponding to the desired outer surface of the flange member. Accordingly, a second mandrel section 140 is provided having an outer configuration similar to that of the desired tube-cone member. Upper die 134 has a recessed surface 135 corresponding to the shape of the mandrels 138, 140. Similarly, lower die 136 is provided with a recessed surface 137.

In operation, a preformed tube blank 142 is slidingly fitted with respect to about the second and first mandrels so as to fit therein. The tube blank is substantially cylindrical, and has prewelded seams or joints. The upper and lower dies 134, 136 are then closed upon the blank to form the blank into the desired final shape. The dies are then opened, and mandrels 138, 140 are axially withdrawn with respect to each other by hydraulic cylinder mechanisms 146, 148 which are connected to the mandrel elements by piston rods 150, 152, respectively. After the mandrels have been displaced, the formed tubecone member is removed from the first and second mandrel sections 138, 140.

Figure 11:
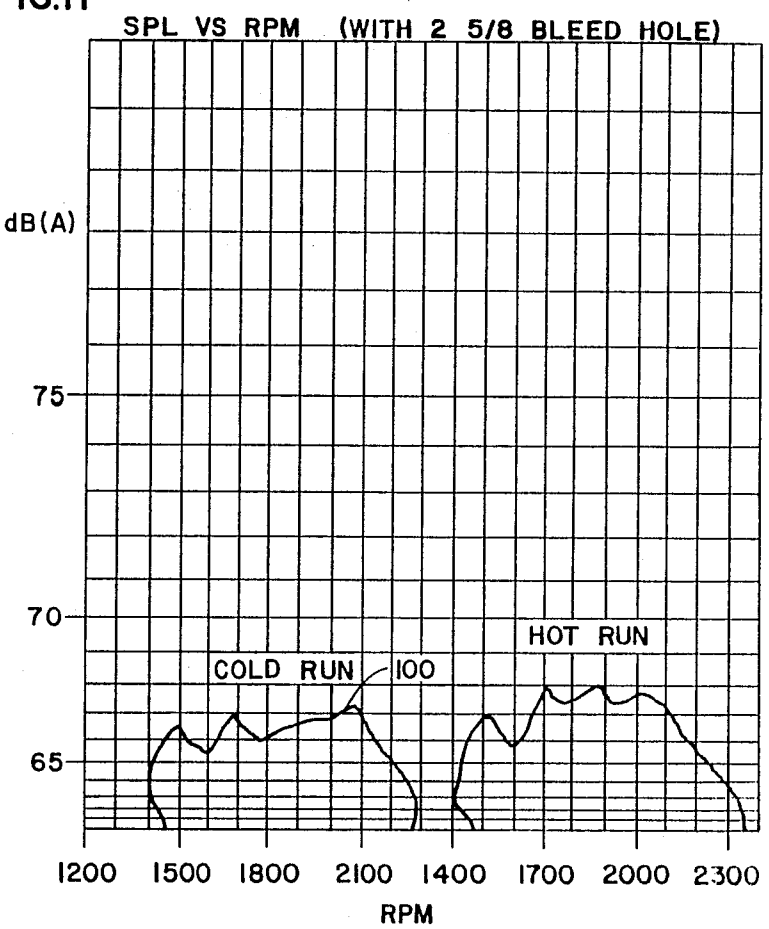
FIG. 11 is an exhaust noise attenuation curve for a muffler according to the embodiment of FIG. 4, in which holes are provided in the baffle member.
Figure 10:
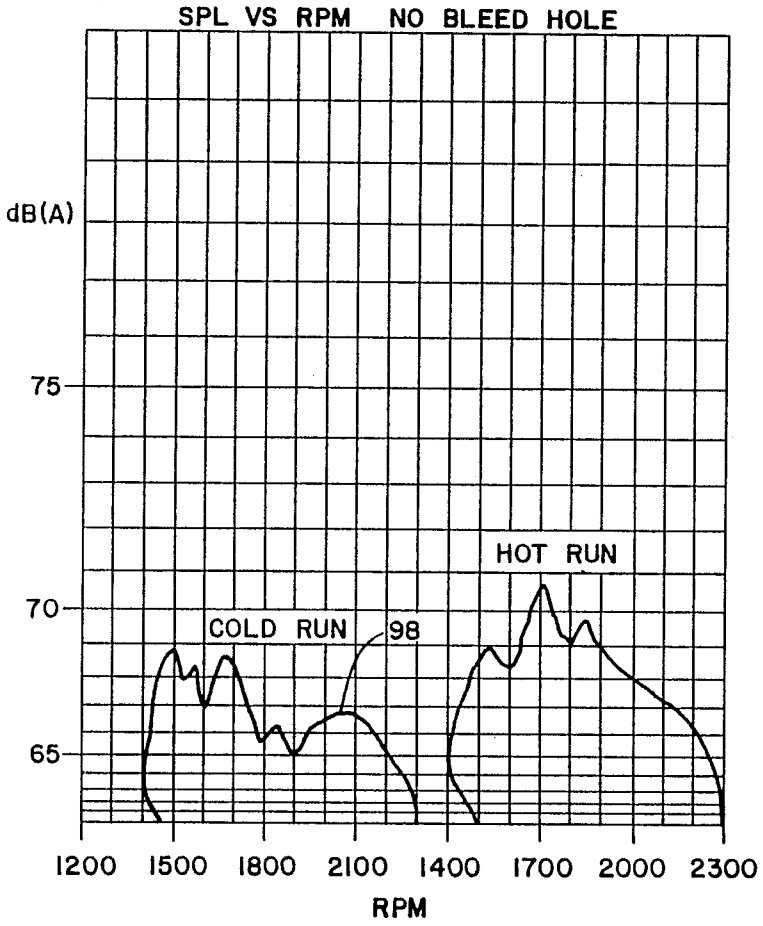
FIG. 10 an exhaust noise attenuation curve for a muffler constructed according to the embodiment of FIG. 4, in which no bleed holes are provided in the baffle member.

The advantages derived from the use of the bleed holes 42 in the central baffle 24, as illustrated in FIG. 1, is best shown by the comparative attenuation curves illustrated in FIGS. 10 and 11. In FIG. 10, curves 98 illustrate the attenuation characteristics of a muffler in which no bleed holes are provided in baffle 24, under different testing conditions. The leftmost curves depict an engine during a cold-run start-up. The rightmost curves depict an engine running at its full load operating temperature. Curves 100 in FIG. 11 represent the attenuation characteristics of a muffler under the same hot and cold running conditions as in FIG. 10, in which two holes each having a diameter of five-eighths of an inch are provided in the central baffle 24. As may clearly be seen by comparing curves 100 to curves 98, the muffler assembly including the two bleed holes in the central baffle attenuates exhaust noise much more efficiently, especially in the 1400-2000 r.p.m. range.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A muffler assembly for use with an internal combustion engine, comprising:

an elongate outer housing having first and second ends and an interior chamber defined therein;

inlet tube means having a first end adapted for receiving exhaust gases from an engine, said inlet tube means mounted at said first end of said housing and including a second end partially extending into said interior chamber;

outlet tube means having a first end for receiving exhaust gases from said inlet tube means and a second end, said outlet tube means being mounted at said second end of said housing so that said first end extends into said chamber, said outlet tube means having a first cylindrical section mounted to said housing, a second conical section decreasing in cross-section from said first section toward said inlet tube means and a flange section which flanges outwardly from said second section to a maximum diameter proximate to but not in contact with said inlet tube means; and baffle means sealingly disposed about said second conical section of said outlet tube means for attenuating engine noise, said baffle means having means defined therein for allowing limited gas movement therethrough, whereby a component of engine noise is efficiently attenuated.

2. Apparatus according to claim 1, wherein said cylindrical section of said outlet tub means has a plurality of perforations formed therein for further attenuating exhaust noise.

3. Apparatus according to claim 1, wherein said cylindrical section of said outlet tube means has a plurality of perforations formed therein, for allowing exhaust noise to bleed into one of said spaces and thereby be attenuated.

4. Apparatus according to claim 1, wherein said inlet tube means decreases in cross-section toward said second end, thereby guiding exhaust gases toward said flange section of said outlet tube means.

5. Apparatus according to claim 1, wherein said means for allowing limited gas movement through said baffle means comprises at least one hole defined in said baffle means.

6. Apparatus according to claim 5, wherein said means for allowing limited gas movement through said baffle means comprises two holes formed in said baffle means, each having a diameter of approximately five one-eighths of an inch.

* * * * *

UNITED STATES PATENT AND TRADEMARK OFFICE

CERTIFICATE OF CORRECTION

PATENT NO. : 4,969,537

DATED : November 13, 1990

INVENTOR(S) : Wagner et al.

It is certified that error appears in the above-identified patent and that said Letters Patent is hereby corrected as shown below:

Column 3, line 27,

INSERT --view of a-- after "cross-sectional"

Column 8, line 4, cancel "tub" and insert therefor --tube--

Signed and Sealed this

Fourth Day of August, 1992

*Attest:*

DOUGLAS B. COMER

*Attesting Officer*

*Acting Commissioner of Patents and Trademarks*